US006729410B2

(12) United States Patent
Steele

(10) Patent No.: US 6,729,410 B2
(45) Date of Patent: May 4, 2004

(54) MULTIPLE TUBE STRUCTURE

(75) Inventor: David J. Steele, Irving, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 13 days.

(21) Appl. No.: 10/083,020

(22) Filed: Feb. 26, 2002

(65) Prior Publication Data

US 2003/0159827 A1 Aug. 28, 2003

(51) Int. Cl.[7] ..... E21B 43/00; E21B 19/00

(52) U.S. Cl. ..... 166/313; 166/384; 166/242.6; 166/242.3

(58) Field of Search ..... 166/50, 242.3, 166/242.6, 313, 384, 385

(56) References Cited

U.S. PATENT DOCUMENTS

| | | | | |
|---|---|---|---|---|
| 4,424,859 A | * | 1/1984 | Sims et al. | 166/313 |
| 5,246,070 A | * | 9/1993 | Greve et al. | 166/242.3 |
| 5,680,901 A | * | 10/1997 | Gardes | 166/313 |
| 5,803,170 A | * | 9/1998 | Garcia-Soule et al. | 166/242.3 |
| 5,904,209 A | * | 5/1999 | Kenworthy et al. | 166/242.3 |
| 6,138,761 A | * | 10/2000 | Freeman et al. | 166/50 |
| 6,158,513 A | * | 12/2000 | Nistor et al. | 166/313 |
| 6,283,206 B1 | | 9/2001 | Fraser et al. | |
| 6,311,776 B1 | * | 11/2001 | Pringle et al. | 166/313 |
| 6,561,277 B2 | * | 5/2003 | Algeroy et al. | 166/50 |

FOREIGN PATENT DOCUMENTS

| | | |
|---|---|---|
| GB | 2038906 A | 7/1980 |
| GB | 2353309 A | 11/1999 |
| WO | 94/10492 A1 | 5/1994 |

OTHER PUBLICATIONS

Search Report for U.K. Patent Application NO.: GB 0303729.8.

David J. Steele and Steinar Edholm, "New Through–Tubing Junction Isolation System Enables High–Pressure Stimulation in the Ekofisk X–02 North Sea Multilateral Well: Case History, " SPE 63268, dated Oct., 2000.

Frode Berge, et al., "A New Generation Multilateral System for the Troll Olje Field –Development and Case History," SPE 71837, dated Sep., 2001.

Sperry–Sun Drilling Services, "Multilateral Services Profile, ITBS Isolated Tie–Back System," dated, Sep., 2000.

* cited by examiner

*Primary Examiner*—David Bagnell
*Assistant Examiner*—Brian Halford
(74) *Attorney, Agent, or Firm*—J. Richard Konneker; Marlin R. Smith

(57) ABSTRACT

A multiple tube structure provides enhanced utilization of limited cross-sectional area in a wellbore. In a described embodiment, a tube system includes multiple tubular members rigidly attached to each other along axial lengths thereof. The tubular members are configured so that they conform to an interior of a generally D-shaped portion of a circle.

65 Claims, 4 Drawing Sheets

MULTIPLE TUBE STRUCTURE

BACKGROUND

The present invention relates generally to operations performed and equipment utilized in conjunction with a subterranean well and, in an embodiment described herein, more particularly provides a multiple tube structure and methods of using same.

Cross-sectional area in a wellbore is a limited commodity. The wellbore must accommodate equipment and tubing strings passing therethrough, and must provide sufficient flow area for efficient production or injection of fluids therethrough.

In general, where multiple tubing strings are used in a single wellbore, conventional circular cross-section tubing strings have merely been positioned side-by-side in the wellbore. Although this may be the easiest solution, it is also very inefficient in utilizing the available cross-sectional area in the wellbore.

Another solution is to manufacture the tubing strings so that each has a generally D-shaped cross-section. When positioned side-by-side in the wellbore, the two tubing strings together have a generally circular cross-section and occupy a substantial portion of the cross-sectional area of the wellbore, and are therefore able to utilize more of this area for fluid flow, access, etc. Such a tube system is found in the Isolated Tie-Back System marketed by Sperry-Sun Drilling Services.

Although the D-shaped tubes used in the Isolated Tie-Back System represent a significant advance in the art, they do have a few disadvantages. One disadvantage is that the D-shaped tubes are somewhat expensive to manufacture. Another disadvantage is that they have not been designed to accommodate additional lines, such as electrical, hydraulic, fiber optic, etc., other than by placing these lines in the interiors of the tubes. Yet another, perhaps most important, disadvantage is that the D-shaped tubes have a relatively low burst and collapse strength as compared to a circular tube having equivalent cross-sectional area and wall thickness.

Therefore, it may be seen that it would be desirable to provide a multiple tube structure which both efficiently utilizes the available cross-sectional area in a wellbore, which accommodates additional lines therein and which has increased burst and collapse strength.

SUMMARY

In carrying out the principles of the present invention, in accordance with an embodiment thereof, a tube system is provided which eliminates disadvantages in the art and permits multiple tubular members to be efficiently utilized in a well. Methods of positioning multiple tubular members in a well are also provided.

In one aspect of the invention, a tube system for use in a subterranean well is provided. The tube system includes multiple tubular members rigidly attached to each other along axial lengths thereof. The tubular members may be configured so that they conform to an interior of a generally D-shaped portion of a circle.

In another aspect of the invention, a method of positioning multiple tubular members in a well is provided. The method includes the steps of attaching the tubular members to each other along axial lengths thereof, and then positioning the attached tubular members in the well. The tubular members may be attached to each other so that the attached tubular members have a generally D-shaped cross-section.

In yet another aspect of the invention, the attached tubular members may be secured to a fluid conduit at ends thereof, so that the attached tubular members and the fluid conduit extend in the same axial direction. The fluid conduit may also be made up of a plurality of attached tubes. The attached tubular members may be positioned in one wellbore of the well, and the fluid conduit may be positioned in another wellbore of the well. The attached tubular members may be sealingly engaged with a sealing receptacle in one wellbore, while the fluid conduit is sealingly engaged with another sealing receptacle in the other wellbore.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
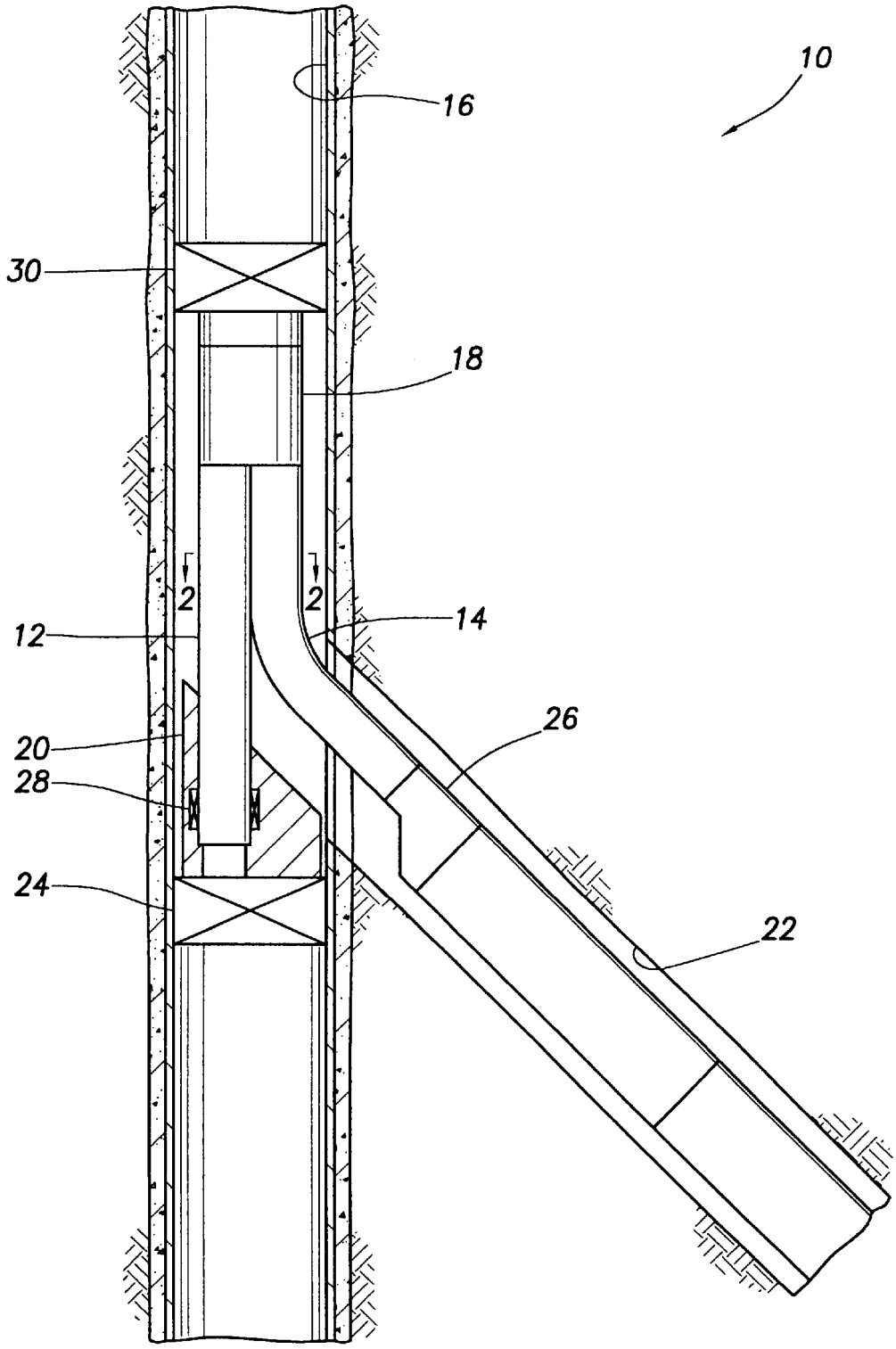
FIG. 1 (PRIOR ART)
FIG. 1 is a cross-sectional view of a prior art isolated tie-back system.

In FIG. 1 is illustrated an example of the Isolated Tie-Back System 10 marketed by Sperry-Sun Drilling Services. The system 10 utilizes two tubing strings 12, 14 having D-shaped cross-sections positioned side-by-side in a parent wellbore 16. The tubing strings 12, 14 are run into the wellbore 16 together and are secured to each other at an upper end thereof by a Y-connector 18.

A deflector 20 positioned in the wellbore 16 deflects the longer tubing string 14 from the parent wellbore into a branch wellbore 22 as the tubing strings are conveyed into the well. The deflector 20 is positioned in the parent wellbore 16 and secured therein by an anchoring device 24, which may be a packer, a latch and inflatable seals, etc.

The tubing string 14 may have equipment, such as well screens, etc. attached at a lower end thereof. A connector 26 adapts the D-shaped tubing string 14 to the generally cylindrical shaped equipment attached therebelow.

The tubing string 12 is not deflected into the branch wellbore 22, but instead is directed into the deflector 20. Seals 28 in the deflector 20 sealingly engage the tubing string 12.

With the tubing string 14 extending into the branch wellbore 22 and the tubing string 12 received within the deflector 20, an anchoring device 30, such as a liner hanger, is set in the parent wellbore 16. The anchoring device 30 secures the tubing strings 12, 14 in position and permits commingled flow via the tubing strings to the parent wellbore above the anchoring device.

Figure 2:
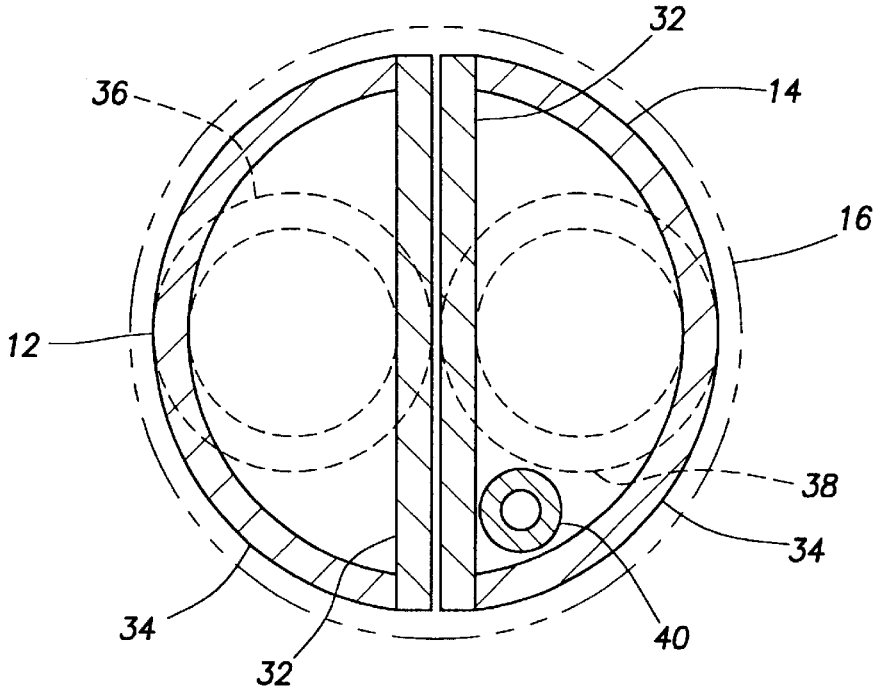
FIG. 2 is an enlarged scale cross-sectional view through D-tube structures of the isolated tie-back system, taken along line 2—2 of FIG. 1.

Referring additionally now to FIG. 2, an enlarged cross-section taken along line 2—2 of FIG. 1 is illustrated. In this view, the D-shaped cross-sections of the tubing strings 12, 14 may be clearly seen. Each of the tubing strings 12, 14 is made up of a flat inner side 32 and a curved outer side 34.

Each inner side 32 is welded along its longitudinal edges to one of the outer sides 34.

Note that, with the tubing strings 12, 14 positioned side-by-side, they utilize a substantial portion of the cross-sectional area of the parent wellbore 16 (a drift diameter of which is shown in phantom lines in FIG. 2). In particular, each of the tubing strings 12, 14 has a larger internal flow area as compared to circular cross-section tubing strings 36, 38 (shown in dashed lines in FIG. 2) positioned side-by-side in the wellbore 16. The D-shape, therefore, more efficiently utilizes the cross-sectional area available in the wellbore 16 for fluid flow.

However, if it is desired to additionally convey another line 40 along with one of the tubing strings 12, 14, this line must be either positioned inside of the tubing string (as shown in FIG. 2), or the line must be positioned outside of the tubing string. If positioned inside the tubing string 12 or 14, the line 40 may bind in the inside corners of the D-shape, and special connectors may be required to conduct the line into, and then out of, the tubing string. If positioned outside the tubing strings 12, 14, then the line 40 will require that the outer dimensions of the tubing strings be reduced.

Figure 3:
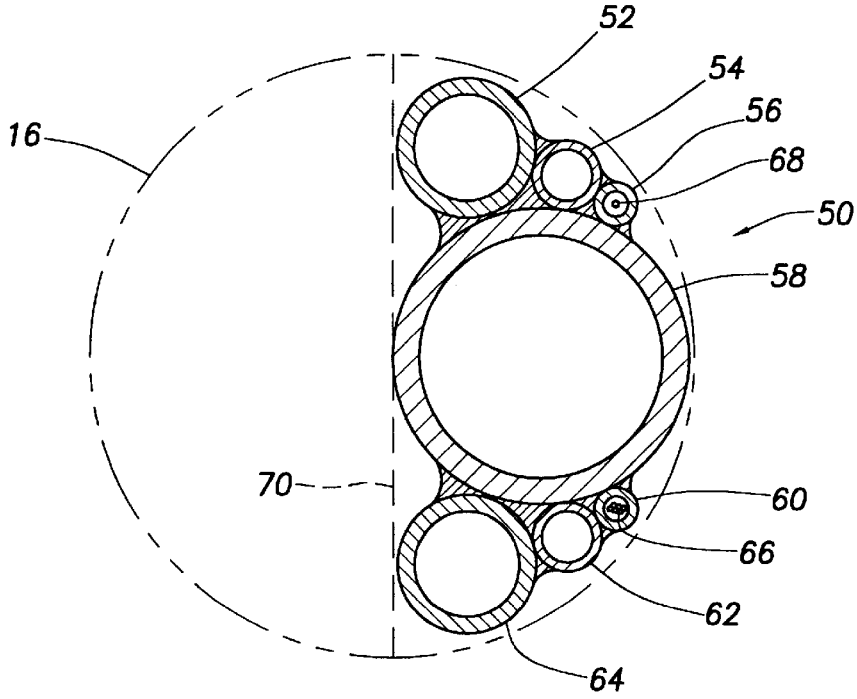
FIG. 3 is a cross-sectional view of a multiple tube structure embodying principles of the present invention.

Representatively illustrated in FIG. 3 is a multiple tube structure 50 which embodies principles of the present invention. In the following description of the structure 50 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The multiple tube structure 50 is made up of tubular members 52, 54, 56, 58, 60, 62, 64. Of course, any number of tubes may be used in the structure 50 in keeping with the principles of the invention. The tubes 52, 54, 56, 58, 60, 62, 64 may also be positioned differently from that shown in FIG. 3.

The tubes 52, 54, 56, 58, 60, 62, 64 are rigidly attached to each other along axial lengths thereof, preferably along their entire, or substantially entire, axial lengths. As depicted in FIG. 3, the tubes 52, 54, 56, 58, 60, 62, 64 are attached to each other by welding, but other attaching means, such as adhesives, etc., may be used without departing from the principles of the invention. The tubes 52, 54, 56, 58, 60, 62, 64 may be attached to each other by spot welding, by continuous welding, or using any other fastening means.

Multiple individual sections of the structure 50 may be joined by couplings or "junction blocks" 72 to produce a desired length. The couplings 72 could mechanically connect the tubes 52, 54, 56, 58, 60, 62, 64 to each other, with or without the tubes also being welded or otherwise attached to each other. The tubes 52, 54, 56, 58, 60, 62, 64 may also be attached to each other by integrally forming them, such as by extruding the structure 50.

Although only one structure 50 is shown in FIG. 3 for clarity of illustration, it will be readily appreciated that another structure may be positioned on an opposite side of a dashed line 70 separating the wellbore 16 into two D-shaped circular portions. Thus, there may be two of the structures 50 positioned in the wellbore 16. Alternatively, the structure 50 could be wedged-shaped, so that three or more of the structure could be positioned in the wellbore 16.

As another alternative, the structure 50 may be positioned in the wellbore side-by-side with another type of fluid conduit, such as one of the tubing strings 12, 14. In particular, the structure 50 may be used in place of either or both of the tubing strings 12, 14 in the method 10.

Centrally located in the structure 50 is the tube 58, which has a larger interior flow area than any of the other tubes 52, 54, 56, 60, 62, 64. Thus, the tube 58 may serve as a main production fluid conduit in a well. Note that the flow area of the tube 58 is at least as great as that of the circular cross-section tubing strings 36, 38 shown in FIG. 2.

It is to be clearly understood that it is not necessary for the structure 50 to have a large central tube 58 surrounded by smaller tubes 52, 54, 56, 58, 60, 62, 64. Any number of tubes in any combination of sizes may be used in keeping with the principles of the invention.

The additional tubes 52, 54, 56, 60, 62, 64 provide additional functionality to the structure 50, while still permitting it to fit within the internal drift diameter of the wellbore 16 with another fluid conduit. As depicted in FIG. 3, the tube structure 50 is generally D-shaped, and so it can fit side-by-side with another tube structure 50, or with one of the D-shaped tubing strings 12, 14, within the drift diameter of the wellbore 16. It is to be clearly understood, however, that the structure 50 could have another cross-sectional shape, without departing from the principles of the invention.

The tubes 52, 54, 56, 58, 60, 62, 64 may each serve various purposes. As stated above, the central tube 58 may serve as a main fluid flow conduit. The tube 60 may contain an electrical line 66, for example, to deliver power or permit communication in the well. The tube 56 may contain a fiber optic line 68. The tubes 54, 62 may be used to conduct hydraulic fluid for actuation of downhole devices, such as safety valves, etc. The tubes 52, 64 may be used for chemical injection, or for additional production flow area. Any of the tubes 52, 54, 56, 58, 60, 62, 64 may be used for any purpose in keeping with the principles of the invention.

Since the tube structure 50 is made up of circular cross-section tubes 52, 54, 56, 58, 60, 62, 64, which are readily available, and no special fabrication processes are needed to form the tubes, the structure may be manufactured more economically as compared to the tubing strings 12, 14 described above. The circular shapes of the tubes 52, 54, 56, 58, 60, 62, 64 provide increased burst and collapse strength as compared to the non-symmetrical D-shaped tubes 12, 14. However, it should be understood that the tubes 52, 54, 56, 58, 60, 62, 64 may each have a cross-section other than circular in shape, without departing from the principles of the invention.

Since the attached tubes 52, 54, 56, 58, 60, 62, 64 have a generally D-shaped cross-section, they utilize a substantial portion of the available cross-sectional area in the wellbore 16 when positioned side-by-side with another D-shaped cross-section tubing string. Although the structure 50 does not provide as much total flow area as either of the tubing strings 12, 14, it does provide more available flow area than the tubing strings 36, 38 and in addition provides multiple tubes for electrical and fiber optic lines, hydraulic control lines, chemical injection, etc.

Figure 4:
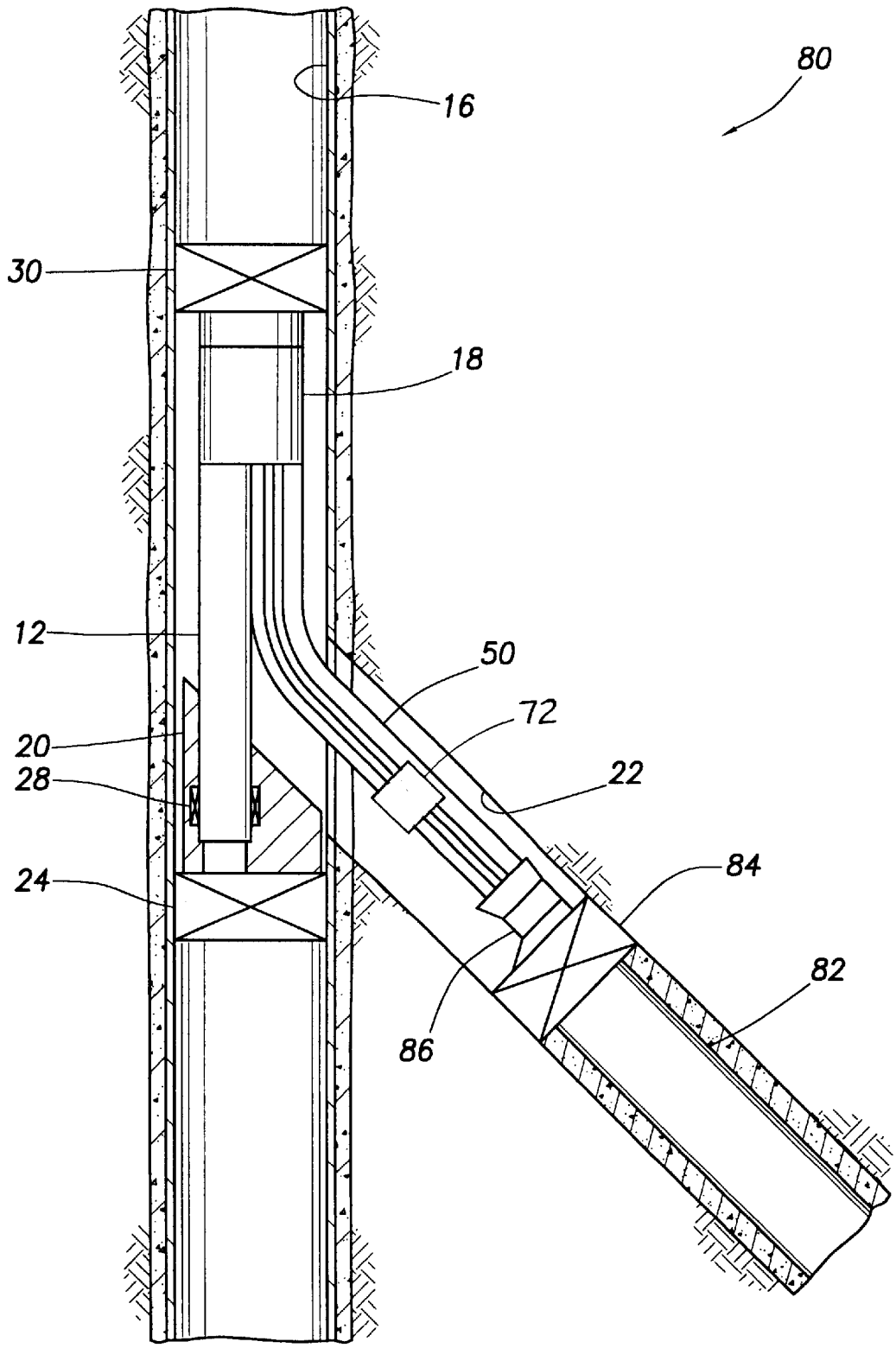
FIG. 4 is a cross-sectional view of a method utilizing the multiple tube structure in an isolated tie-back system.

Referring additionally now to FIG. 4, a method 80 of positioning multiple tubular members in a well is representatively illustrated, the method embodying principles of the invention. In the method 80, some similar elements are used as in the method 10 described above, and these elements are indicated in FIG. 4 using the same reference numbers. Of course, other elements could be used, without departing from the principles of the invention.

In the method 80, the structure 50 is attached at one end thereof to the connector 18 in place of the tubing string 14. Thus, the structure 50 is conveyed into the parent wellbore 16 in a side-by-side, non-telescoped relationship with the tubing string 12. Of course, the structure could also, or alternatively, be conveyed into the parent wellbore 16 with another type of fluid conduit. The structure 50 is deflected by the deflector 20 into the branch wellbore 22, and the tubing string 12 is sealingly received in the deflector 20.

Instead of having various items of equipment attached to the structure 50 when it is conveyed into the parent wellbore 16 as in the method 10, such equipment is previously installed and cemented in the branch wellbore 22 in the method 80. As depicted in FIG. 4, a liner string 82 is cemented in the branch wellbore 22 below a packer 84, liner hanger, or other anchoring device.

Of course, it is not necessary for the equipment to be previously installed in the branch wellbore 22, since the equipment could be attached to a lower end of the structure 50 and deflected into the branch wellbore as the structure is lowered in the parent wellbore 16 as in the method 10. Furthermore, it is not necessary for the equipment to be cemented in the branch wellbore 22, since the equipment could be anchored using an open hole packer, an inflatable packer, or otherwise suspended in the branch wellbore, etc.

Attached to the packer 84 is a specially configured sealing receptacle 86 for sealingly engaging the lower end of the structure 50. The sealing receptacle 86 is somewhat similar to a conventional polished bore receptacle, but is complementarily shaped to sealingly receive one or more of the tubes 52, 54, 56, 58, 60, 62, 64 of the structure 50. For example, the receptacle 86 may have a seal bore therein complementarily shaped relative to the tubes received therein. After the structure 50 is received in the receptacle 86, the anchoring device 30 is set in the parent wellbore 16.

Note that, after the tubing string 12 is sealingly received in the deflector 20, the structure 50 is sealingly received in the receptacle 86 and the anchoring device 30 is set in the parent wellbore 16, the formation surrounding the intersection of the wellbores 16, 22 is isolated from the production fluid flows in the tubing string 12 and in the structure 50. In addition, note that the structure 50 could be used alternatively, or additionally, to replace the tubing string 12.

Figure 5:
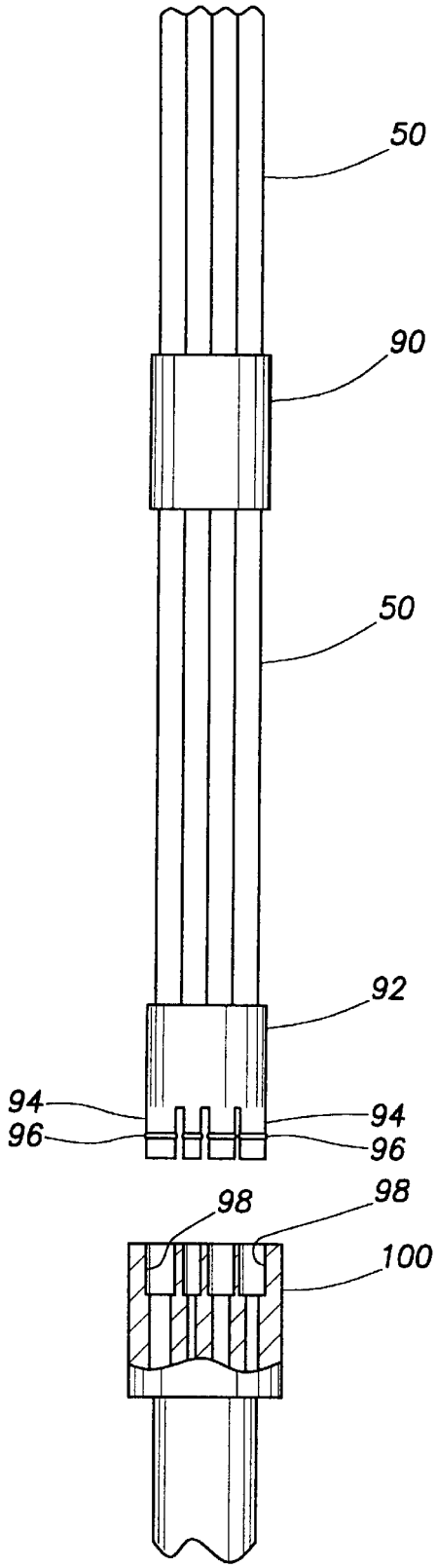
FIG. 5 is a side view of a method of connecting the multiple tube structure to other equipment in a well.

Referring additionally now to FIG. 5, another alternative is representatively illustrated for attaching the tubes of the structure 50, and connecting the tubes of the structure to other equipment in a well. As depicted in FIG. 5, the tubes of the structure 50 are attached to each other by means of a junction block 90 interconnected between sets of the tubes. In this manner, the tubes are attached to each other, and multiple sets of the tubes may be interconnected to achieve any desired total length.

The tubes could be threaded into the junction block 90, welded to the junction block, or connected using any other means, such as adhesives. Preferably, each tube is also sealed to the junction block 90. Of course, welding or the use of adhesives could accomplish both the connecting and sealing functions. If the tubes are connected to the junction block 90 by threading, then seals, such as o-rings, gaskets, packing, etc., could be used to perform the sealing function, or self-sealing threads could be used.

Where a junction block 90 is used, the tubes of the structure 50 may or may not additionally be attached to each other using welding, adhesives, etc. along axial lengths thereof. Appropriately spaced, multiple junction blocks 90 may satisfactorily accomplish the attachment of the tubes to each other along axial lengths thereof, without the need for additional attachment means.

At a lower end of a lowermost one of the interconnected structures 50 shown in FIG. 5 is a junction block 92 which is similar in many respects to the junction block 90 described above. However, the lower junction block 92 is used to connect the tubes of the structure 50 to other equipment in a well, such as the packer 84 in the method 80 of FIG. 4 (in which case the lower junction block and sealing receptacle 100 would replace the sealing receptacle 86), or the liner in the method 10 of FIG. 1 when the structure 50 is used to replace the tubing string 14 (in which case the lower junction block and sealing receptacle 100 would replace the connector 26). When the structure 50 is used to replace the tubing string 12 in the method 10, the lower junction block 92 could be used instead of the seal 28 in the bore of the deflector 20.

The lower junction block 92 includes multiple downwardly extending conduits 94 having seals 96 thereon. The conduits 94 are stabbed into multiple seal bores 98 formed in a sealing receptacle 100, with the seals 96 sealing against the respective bores. Of course, the seals 96 could alternatively be carried on the receptacle 100 for sealing engagement with the conduits 94, or with bores formed in the lower junction block 92. As another alternative, the seals 96 could be carried on the individual tubes of the structure 50.

Where one or more of the tubes of the structure 50 are used to convey electric or fiber optic lines 66, 68, then the junction block 92 and receptacle 100 may include appropriate electrical or fiber optic connectors for these lines.

The structure 50 may also be used in other methods, including other methods which are not related to the Isolated Tie-Back System, without departing from the principles of the invention. For example, in a high volume production well where the operator wants to produce at a high rate from two separate zones, but a conventional 9-⅝" dual packer with two strings of 3½" tubing would limit the amount of production, two of the structures 50 could be run below the packer (with D-shaped mandrels) to provide increased flow area. Above the packer, the structures 50 could be run up into a larger diameter casing where they could be connected to two tubing strings, e.g., 4½" or 5" tubing strings.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A tube system for use in a subterranean well, the tube system comprising:

multiple tubular members rigidly attached to each other along axial lengths thereof, the attached tubular members having a cross-section complementarily shaped relative to an interior of a generally D-shaped portion of a circle.

2. The tube system according to claim 1, wherein each of the tubular members has a generally circular cross-section.

3. The tube system according to claim 1, wherein the tubular members are attached to each other by welding along the axial lengths thereof.

4. The tube system according to claim 1, wherein the multiple tubular members include a first tube generally centered within the D-shaped portion.

5. The tube system according to claim 4, wherein the multiple tubular members further include at least one second tube positioned adjacent the first tube within the D-shaped portion.

6. The tube system according to claim 5, wherein the at least one second tube is smaller in cross-sectional area than the first tube.

7. The tube system according to claim 6, wherein each of the second tubes is smaller in cross-sectional area than the first tube.

8. The tube system according to claim 4, wherein the multiple tubular members further include multiple second tubes positioned on each opposite lateral side of the first tube within the D-shaped portion.

9. The tube system according to claim 1, wherein the tubular members are sealingly engaged with a sealing receptacle in the well.

10. The tube system according to claim 9, wherein the sealing receptacle is a seal bore complementarily shaped relative to the tubular members.

11. The tube system according to claim 9, wherein the sealing receptacle is attached to an anchoring device set in the well.

12. The tube system according to claim 1, wherein the attached tubular members are deflected from a first wellbore into a second wellbore.

13. The tube system according to claim 12, wherein the tubular members are sealingly engaged with a sealing receptacle in the second wellbore while a portion of the attached tubular members remains within the first wellbore.

14. The tube system according to claim 1, further comprising at least one junction block interconnected between axial sections of the tubular members, the junction block providing a sealed connection between corresponding tubular members in each axial section.

15. The tube system according to claim 1, wherein at least one of the attached tubular members contains a communication line.

16. The tube system according to claim 15, wherein the communication line is a fiber optic line.

17. The tube system according to claim 15, wherein the communication line is an electrical line.

18. The tube system according to claim 15, wherein the communication line extends from a first wellbore into a second wellbore which intersects the first wellbore.

19. The tube system according to claim 1, wherein at least one of the attached tubular members is a hydraulic line.

20. The tube system according to claim 19, wherein the hydraulic line is a control line.

21. The tube system according to claim 19, wherein the hydraulic line extends from a first wellbore into a second wellbore which intersects the first wellbore.

22. The tube system according to claim 1, wherein at least one of the attached tubular members is a chemical injection line.

23. The tube system according to claim 22, wherein the chemical injection line extends from a first wellbore into a second wellbore which intersects the first wellbore.

24. A method of positioning multiple tubular members in a subterranean well, the method comprising the steps of:

attaching the tubular members to each other along axial lengths thereof, the attached tubular members being in a side-by-side, non-telescoped relationship; and then positioning the attached tubular members in the well, the positioning step comprising positioning the attached tubular members so that they are positioned in each of first and second intersecting wellbores.

25. The method according to claim 24, wherein the attaching step further comprises welding the tubular members to each other along the axial lengths thereof.

26. The method according to claim 24, wherein the positioning step further comprises deflecting the attached tubular members from a first wellbore into a second wellbore.

27. The method according to claim 24, wherein the at least one attached tubular member contains a communication line.

28. The method according to claim 27, wherein the communication line is a fiber optic line.

29. The method according to claim 27, wherein the communication line is an electrical line.

30. The method according to claim 27, wherein the communication line extends simultaneously in the first and second wellbores.

31. The method according to claim 24, wherein the at least one attached tubular member is a hydraulic line.

32. The method according to claim 31, wherein the hydraulic line is a control line.

33. The method according to claim 31, wherein the hydraulic line extends simultaneously in the first and second wellbores.

34. The method according to claim 24, wherein the at least one attached tubular member is a chemical injection line.

35. The method according to claim 34, wherein the chemical injection line extends simultaneously in the first and second wellbores.

36. A method of positioning multiple tubular members in a subterranean well, the method comprising the steps of:

attaching the tubular members to each other along axial lengths thereof; and then positioning the attached tubular members in the well, the positioning step comprising positioning an attached tubular member so that it is positioned in each of first and second intersecting wellbores, the attaching step further comprising attaching the tubular members to each other so that the attached tubular members have a generally D-shaped cross-section.

37. A method of positioning multiple tubular members in a subterranean well, the method comprising the steps of:

attaching the tubular members to each other along axial lengths thereof; and then positioning the attached tubular members in the well, the positioning step comprising positioning an attached tubular member so that it is positioned in each of first and second intersecting wellbores, the attaching step further comprising attaching the tubular members to each other so that the attached tubular members have a generally wedge-shaped cross-section.

38. A method of positioning multiple tubular members in a subterranean well, the method comprising the steps of:

attaching the tubular members to each other along axial lengths thereof; and then positioning the attached tubular members in the well, the positioning step comprising positioning an attached tubular member so that it is positioned in each of first and second intersecting wellbores, the attaching step further comprising disposing a first tube generally centrally in the attached tubular members, the first tube having a larger flow area than each of the other tubular members.

39. The method according to claim 38, wherein the attaching step further comprises disposing at least one second tube on each opposite side of the first tube.

40. The method according to claim 38, wherein the attaching step further comprises disposing multiple second tubes on each opposite side of the first tube.

41. A method of positioning multiple tubular members in a subterranean well, the method comprising the steps of:

attaching the tubular members to each other along axial lengths thereof; and then positioning the attached tubular members in the well, the positioning step comprising positioning an attached tubular member so that it is positioned in each of first and second intersecting wellbores, the positioning step further comprising sealingly engaging the tubular members with a sealing receptacle in the well.

42. The method according to claim 41, wherein the sealing receptacle is a seal bore complementarily shaped relative to the tubular members.

43. The method according to claim 41, wherein the sealing receptacle is attached to an anchoring device set in the well.

44. A method of positioning multiple tubular members in a subterranean well, the method comprising the steps of:

attaching the tubular members to each other along axial lengths thereof; and then positioning the attached tubular members in the well, the positioning step comprising positioning an attached tubular member so that it is positioned in each of first and second intersecting wellbores, the positioning step further comprising deflecting the attached tubular members from a first wellbore into a second wellbore and sealingly engaging the tubular members with a sealing receptacle in the second wellbore while a portion of the attached tubular members remains within the first wellbore.

45. A method of positioning multiple tubular members in a subterranean well, the method comprising the steps of:

attaching the multiple tubular members to each other, the attached tubular members having a cross-section complementarily shaped relative to an interior of a generally D-shaped portion of a circle; and then positioning the attached tubular members in the well.

46. The method according to claim 45, wherein the attaching step further comprises attaching the tubular members by welding the tubular members to each other along axial lengths thereof.

47. The method according to claim 45, wherein the attaching step further comprises disposing a first tube generally centrally in the attached tubular members, the first tube having a larger flow area than each of the other tubular members.

48. The method according to claim 47, wherein the attaching step further comprises disposing at least one second tube on each opposite side of the first tube.

49. The method according to claim 45, further comprising the step of securing the attached tubular members to a fluid conduit at first ends thereof, the attached tubular members and the fluid conduit extending in the same axial direction from the first ends to second ends thereof.

50. The method according to claim 49, wherein in the securing step, the fluid conduit is made up of a plurality of attached tubes.

51. The method according to claim 49, wherein the positioning step further comprises positioning the attached tubular members in a first wellbore of the well, and positioning the fluid conduit in a second wellbore of the well.

52. The method according to claim 51, further comprising the steps of sealingly engaging the attached tubular members with a first sealing receptacle in the first wellbore, and sealingly engaging the fluid conduit with a second sealing receptacle in the second wellbore.

53. The method according to claim 49, wherein the securing step further comprises providing fluid communication between the fluid conduit and at least one of the attached tubular members.

54. The method according to claim 45, wherein the attaching step further comprises interconnecting multiple axial sections of the tubular members using a junction block between the interconnected sections.

55. The method according to claim 54, wherein each junction block provides a sealed connection between corresponding tubular members in each axial section.

56. The method according to claim 45, wherein the positioning step further comprises positioning at least one attached tubular member so that it extends in each of first and second intersecting wellbores.

57. The method according to claim 56, wherein the at least one attached tubular member contains a communication line.

58. The method according to claim 57, wherein the communication line is a fiber optic line.

59. The method according to claim 57, wherein the communication line is an electrical line.

60. The method according to claim 57, wherein the communication line extends simultaneously in the first and second wellbores.

61. The method according to claim 56, wherein the at least one attached tubular member is a hydraulic line.

62. The method according to claim 61, wherein the hydraulic line is a control line.

63. The method according to claim 61, wherein the hydraulic line extends simultaneously in the first and second wellbores.

64. The method according to claim 56, wherein the at least one attached tubular member is a chemical injection line.

65. The method according to claim 64, wherein the chemical injection line extends simultaneously in the first and second wellbores.

* * * * *